United States Patent [19]

Haueter

[11] Patent Number: 4,958,976

[45] Date of Patent: Sep. 25, 1990

[54] DEVICE FOR THE STORAGE, INSERTION, AND REMOVAL OF CONTAINERS

[75] Inventor: Ernst Haueter, Bowil, Switzerland

[73] Assignee: Ascom Autelca AG., Gümligen, Switzerland

[21] Appl. No.: 311,733

[22] Filed: Feb. 17, 1989

[30] Foreign Application Priority Data

Mar. 14, 1988 [CH] Switzerland ..... 961/88

[51] Int. Cl.[5] ..... E05G 1/08

[52] U.S. Cl. ..... 414/331; 414/268; 414/277; 414/280; 232/15; 232/16; 109/24

[58] Field of Search ..... 414/227, 281, 331, 268, 414/269, 280; 109/23, 24; 232/15, 16, 17

[56] References Cited

U.S. PATENT DOCUMENTS

| | | | |
|---|---|---|---|
| 3,964,577 | 6/1976 | Bengtsson | 414/281 X |
| 4,186,977 | 2/1980 | Gilovich et al. | 232/15 X |
| 4,370,006 | 1/1983 | Graef et al. | 232/15 X |
| 4,638,746 | 1/1987 | Ishiguire | 232/15 X |
| 4,669,047 | 5/1987 | Chucta | 414/331 X |
| 4,770,591 | 9/1988 | Wright et al. | 414/331 |

FOREIGN PATENT DOCUMENTS

| | | | |
|---|---|---|---|
| 2562523 | 10/1985 | France | 414/331 |
| 0016298 | 2/1977 | Japan | 109/23 |
| 0137703 | 7/1985 | Japan | 414/331 |
| 0092506 | 4/1988 | Japan | 414/277 |
| 8602758 | 5/1986 | World Int. Prop. O. | 414/268 |

*Primary Examiner*—Robert J. Spar
*Assistant Examiner*—John VandenBosche
*Attorney, Agent, or Firm*—Brady, O'Boyle & Gates

[57] ABSTRACT

Device for the storage, insertion, and removal of containers in and, respectively, from a secured space, with racks (14) exhibiting storage sites (16) for the containers, arranged in tiers in superposition. The containers are retained in the racks (14) by respectively one detent spring (35). During transporting of the racks (14), the detent springs (35) are locked by locking elements (44), and the containers are thereby secured in the racks (14). The unlocking of the containers takes place automatically, only after complete introduction of the racks (14) into the secured space, by an unlocking element (65) that is moved into a lock (47) by a bar (67) abutting against a stop (73).

16 Claims, 5 Drawing Sheets

DEVICE FOR THE STORAGE, INSERTION, AND REMOVAL OF CONTAINERS

The invention relates to a device for the storage, insertion, and removal of containers in and from a secured space.

A device for the storage, insertion, and removal of containers in and, respectively, from a secured space with storage sites for the containers arranged in tiers in superposition in racks is utilized with preference in cashier's safes as employed at teller's windows of financial institutions, e.g. banks. A device of this type has been described in EP-A No. 0,182,137. The device involves a strongbox storage means for the reception of strongboxes as the containers, arranged in the interior of an armored cashier's safe. Valuable objects, such as, for example, paper currency and jewelry, are stored in the strongboxes. A storage site is provided for each strongbox. Two storage sites are located in side-by-side relationship at the same level, per rack. In order to remove the contents of the strongboxes, the latter are taken from their storage site in the rack and transported by means of a strongbox carrier to a money depositing and withdrawal site. In order to make it possible to remove each of the two strongboxes, deposited without mechanical fixation, the racks are turned by a complicated rotary mechanism so that the respective side of the rack where the presently desired strongbox is located points toward the strongbox carrier. The racks are fixedly installed in the cashier's safe. The loading and unloading of the strongboxes takes place solely by way of the money depositing and withdrawal site.

Since the strongboxes are disposed in the racks in their storage locations without any mechanical fixation whatever, the turning of the racks must be performed without vibrations so that the strongboxes do not slide off their seats and thereby impede the rotational movement and, respectively, the motion of the strongbox carrier. Inasmuch as the filling and, respectively, emptying of the strongboxes is possible only via the money depositing and withdrawal site, the checking, filling, or emptying of the contents of the strongbox is extremely complicated and time-consuming, and also dangerous from a security standpoint since these manipulations take place in the tellers' customer area.

Thanks to the invention, the object has been attained of providing a device permitting the removal of the racks from the device in order to examine, fill, or empty the containers at a secured location.

A preferred embodiment of the invention makes it possible to lock all of the containers in the racks automatically while being removed from the device so that the containers do not fall out of the racks even in case of relatively vigorous vibrations, and for security reasons cannot be removed during transport.

Preferred embodiments of the locking containers in the racks are disclosed, as well as structure for, the perfect correlation of the racks to a specific reception site in the carrier.

Several embodiments of the device according to this invention will be described in greater detail below with reference to the drawings wherein.

Figure 2:
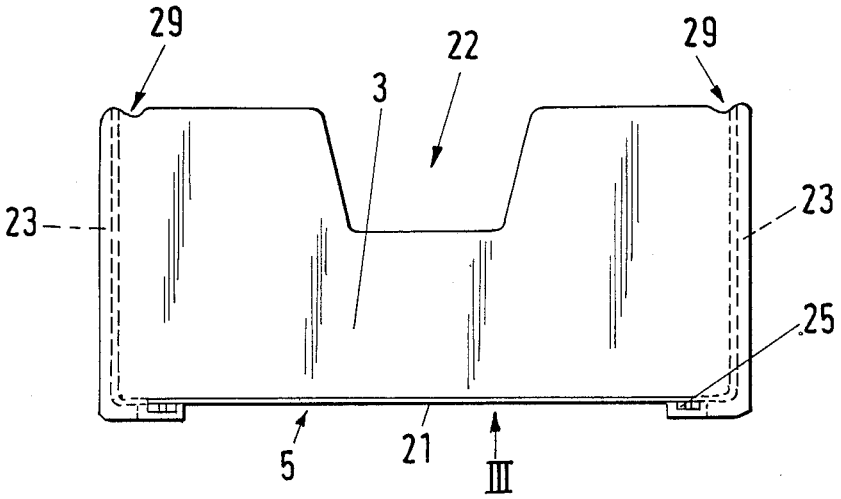
FIG. 2 shows a view of a container from the top.
Figure 5:
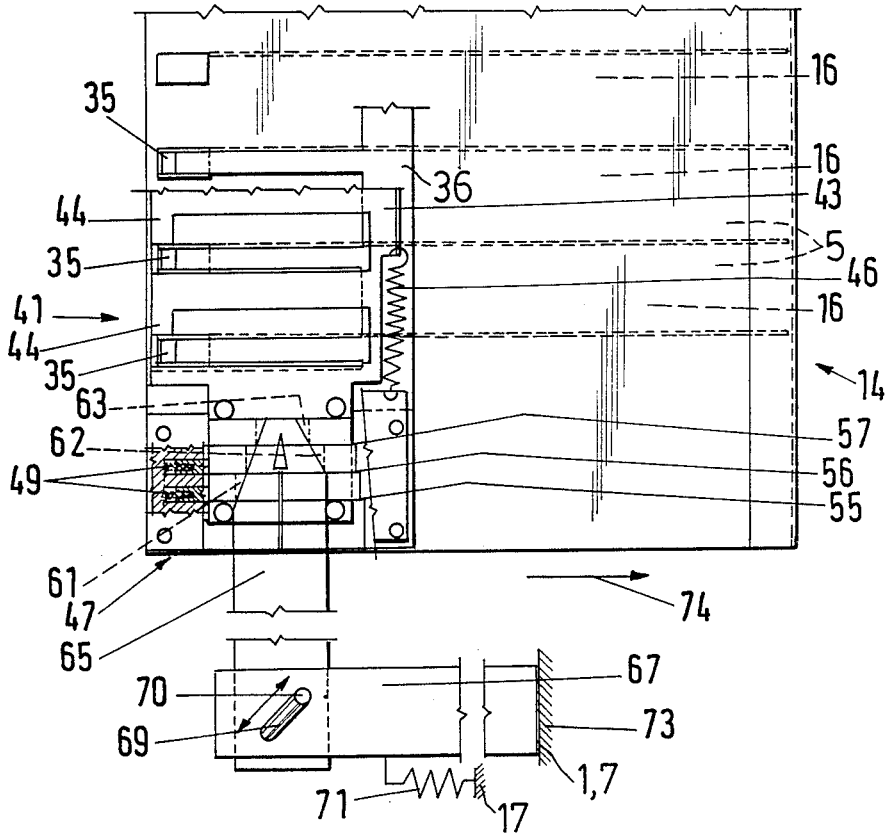
Figure 3:
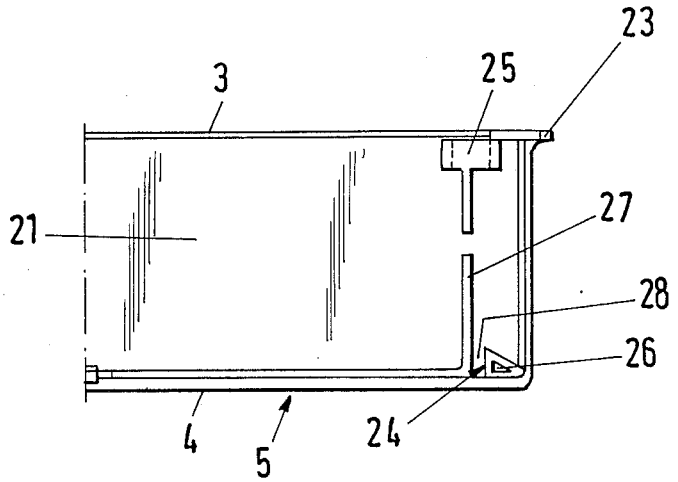
Figure 4:
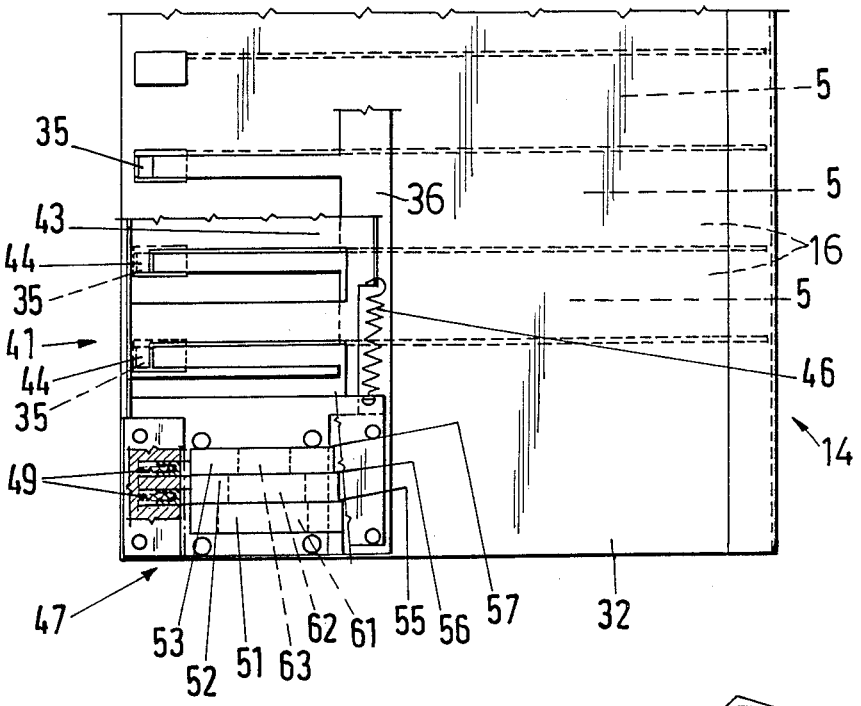
Figure 6:
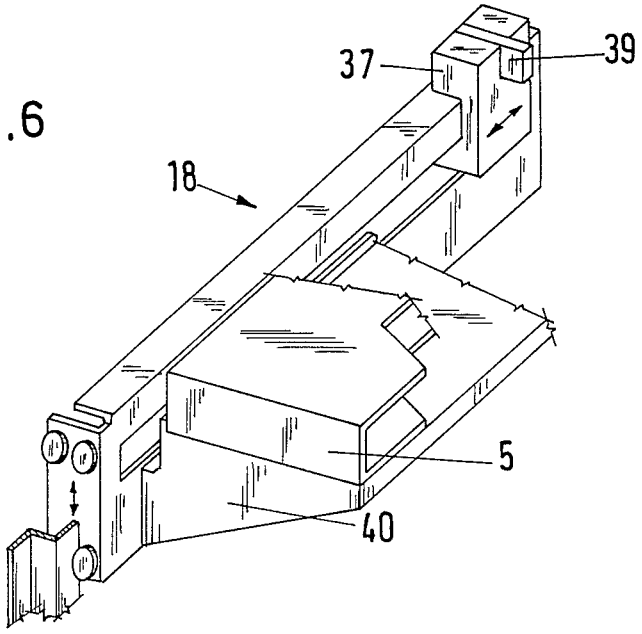
Figure 7:
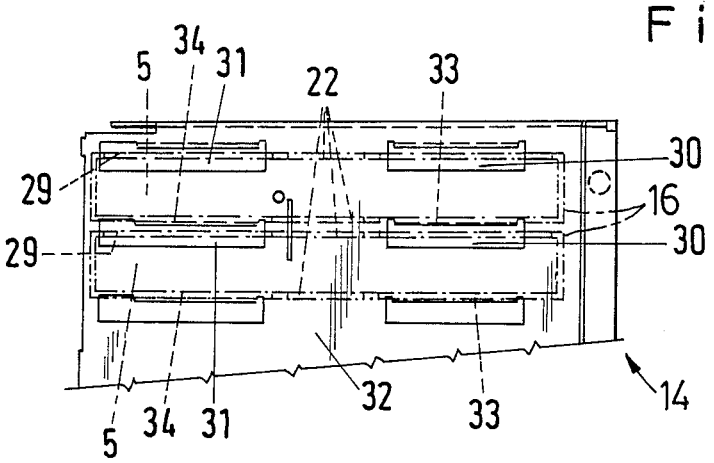
Figure 8:
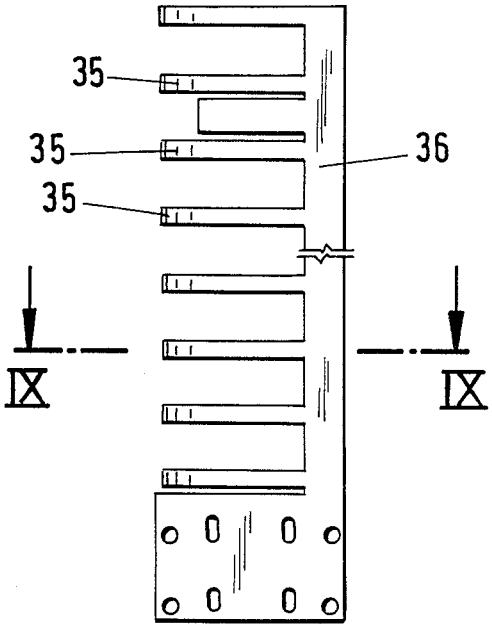
Figure 9:
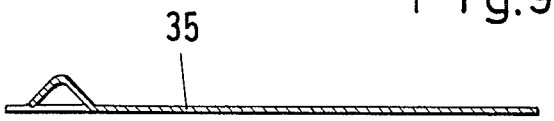
Figure 10:
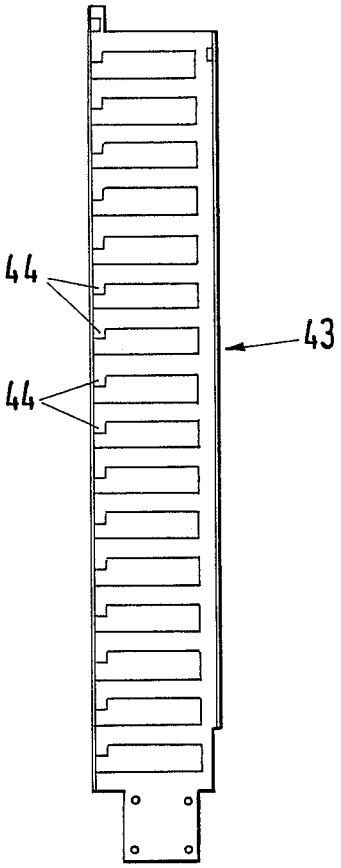
Figure 11:
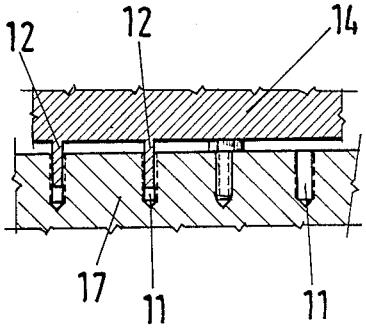

FIG. 3 is a fragmentary view of the container in the viewing direction III in FIG. 2, FIG. 4 shows a diagrammatic view of a rack with locked containers, FIG. 5 shows a diagrammatic view of the rack with unlocked containers, FIG. 6 is a perspective illustration of the conveying means for the containers, FIG. 7 shows a detailed view of a partition of the rack with reinforcing fins, FIG. 8 shows a spring plate of the rack with detent springs, FIG. 9 is a section through a detent spring on an enlarged scale along line IX—IX in FIG. 8, FIG. 10 is a detailed view of the slide with locking elements, and FIG. 11 shows a detailed view in longitudinal section through a pin arrangement as a coding between the rack and the carrier.

Figure 1:
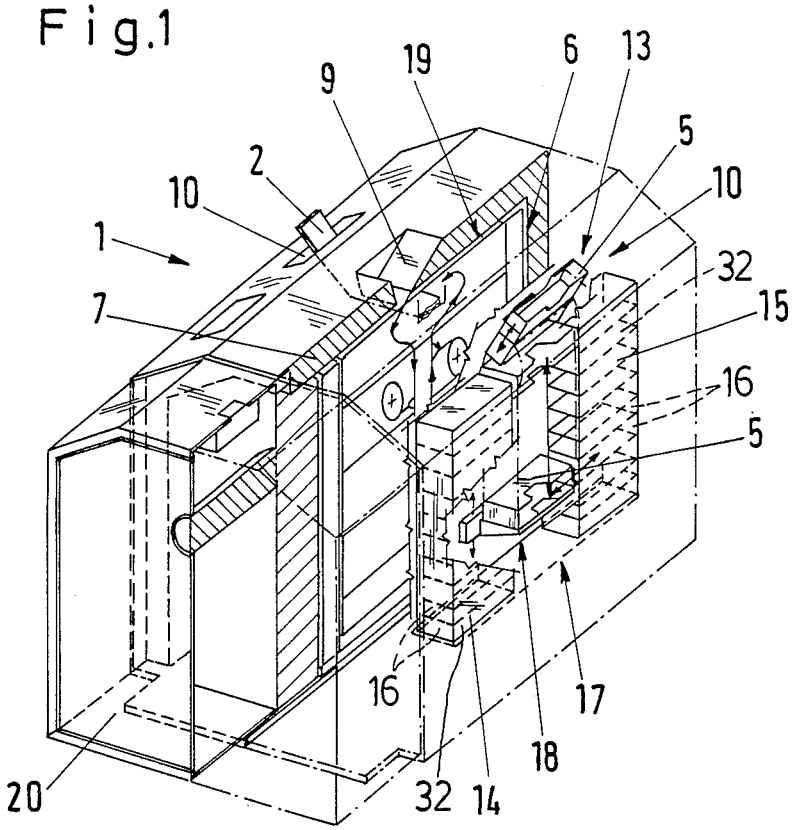
FIG. 1 is a perspective view, partially in section, of a cashier's safe.

The cashier's safe 1 illustrated in FIG. 1 serves for the insertion, storage, and removal of sheetlike material, especially paper currency 2, and of objects storable in containers 5. The interior of the safe, provided with armor 7, is denoted by 6.

The cashier's safe 1 is normally set up between two cashier's windows and is operated jointly by two tellers. The safe exhibits one deposit opening 9 for the paper currency 2 jointly for both tellers, and an opening 10 through which the paper currency 2 and the containers 5 can be passed by means of a pivoting and shifting unit 13 so that the respective teller can take the paper currency 2 and/or the content of container 5, can fill the container, or can inspect the latter.

The containers 5 are accommodated in tiers in respectively one rack 14 and 15 in or on storage sites 16 (FIG. 5) located in the racks one above the other. The two racks 14 and 15 are arranged in a carrier 17 indicated in FIG. 1. The carrier 17 is part of a slide-in unit 19 that can be moved through a safe door 20. The two racks 14 and 15 illustrated in FIG. 1 are associated with the right-hand opening 10. Two corresponding racks, not shown in the drawing, are associated with the left-hand opening 10, these racks resting in a further carrier of the slide-in unit 19.

The racks 14 and 15 can be removed, when the door 20 of the safe is open, from the slide-in unit 19 which latter has been pulled out of the interior 6 of the safe. The taken-outracks 14, 15 are brought into the room in the safe of the financial institution for replenishing, removal, or inspection of the contents of the containers 5. For reasons of safety and insurance, the cashier's safe 1 must not be opened during the time periods when the teller's windows are open.

The racks 14, 15 are designed in mutual mirror-image symmetry. In order to render them installable into the carrier 17 without interchanging, each rack 14, 15 carries on its underside an arrangement of pins 12 as identification, this pin arrangement fitting into a corresponding arrangement of holes 11 in a platform of the carrier 17 on which the racks 14, 15 are disposed.

A conveying means 18 is provided between the two racks 14 and 15 inserted in the carrier 17. This conveying means serves for the horizontal extraction of respectively one of the containers 5 from respectively one of the storage sites 16 the racks 14 and 15, and for the vertical shifting of the extracted container 5 between the racks 14 and 15 approximately in the center of the carrier 17 toward the topside of the latter where the pivoting and shifting unit 13 takes over the container 5 and pushes same through the right hand opening 10.

The containers 5 are unilaterally open parallelepipeds of a synthetic resin, as illustrated in FIGS. 2 and 3. The upper and lower walls 3, 4 of the container 5 have respectively one recess 22 toward the open side, making it easier for the teller to seize the paper currency 2 deposited in the container 5 when the container 5 has been pushed through the opening 10. The container 5 exhibits respectively one extension 23 along its sidewalls on the upper wall 3. On the rear wall 21 lying in opposition to the open side, the container 5 has an eye 25 in the proximity of each sidewall toward the upper wall 3. On the lower wall 4, likewise in the proximity of each sidewall, a prismatic extension 26 is located on the rear wall 21, with a base area corresponding to a right triangle, one side of which extends in parallel to the lower wall 4, and the hypotenuse of which slopes toward the sidewall. A projection 27 lies in parallel to the other side 24 of the right triangle. A gap 28 between the projection 27 and the other side 24 of the right triangle is larger by a tolerance than the thickness of a pawl 39 which will be described below. The upper wall 3 exhibits respectively one indentation 29 in the proximity of the sidewalls on the open side.

The containers 5, as described hereinabove, lie in tiers in the racks 14 and 15. For the sake of simplicity, only the rack 14 will be described with reference to FIGS. 4 and 5, of the two racks 14 and 15 designed in mirror-image relationship.

Respectively one partition 32 (FIG. 7) provided with horizontal reinforcing fins 30 and 31 is disposed on the side of the rack 14 facing the outside of the teller's safe and, respectively, the middle of the teller's safe. The reinforcing fins 30 and 31 are designed so that they form horizontal bearing surfaces 33 and 34, respectively, serving as supports for the containers 5 in their storage locations 16, the containers 5 sliding on these reinforcing fins while being pulled out and inserted. The reinforcing fin 31 lies in the proximity of the rack sidewall facing the safe door 20, and the reinforcing fin 30 is located in the proximity of the conveying means 18. As illustrated in FIG. 7, the horizontal supporting surface 34 is missing on the part of the reinforcing fins 31 facing the safe door 20, and the height of each reinforcing fin 31 is enlarged at this location. Here, in the mounted condition, respectively one detent spring 35 passes through and is disposed, with the container 5 being inserted (illustrated in dot-dash lines in FIG. 7), in the indentation 29 of the container. All detent springs 35 are, as shown in FIG. 8, extensions of a spring plate 36, which is connected with four screws (not illustrated), which pass through the four base holes at the lower ends of the spring plate 36, to the rack 14, 15, is indicated in FIGS. 4 and 5.

The spring plates 36 are fixed to partitions 32 on one side of racks 14, 15 in such a way that the arch of the pawls of the detents 35 are directed towards the containers 5 inside the rack 14, 15, respectively. One detent spring 35 is illustrated in FIG. 9 on an enlarged scale. The detent springs 35 retain the containers 5, against vibrations in the rack 14 in the unlocked condition, by the pawl of the detent spring 35 engaging the indentation 29 on the front of the container 5. As seen in FIG. 4, the arch of the pawl of the detent spring 35 lies inside the indentation 29. Behind the open part of the arch lies the locking element 44 of the slide 43. The retaining force of the detent springs 35 is only of such a magnitude that it can be overcome by the conveying means 18.

The conveying means 18 illustrated schematically in FIG. 6 comprises a horizontally guided slide 37 with a pawl 39 and a vertically displaceable platform 40. In order to pull out a container 5, the platform 40 is moved vertically along guide rails illustrated in FIG. 6, by means of a drive mechanism, not shown, to the level of the respective storage site 16 plus at least the length of the side 24 of the prismatic extension 26 of the container 5. The horizontal slide 37 travels with its pawl 39 in the direction of container 5 until the pawl 39 abuts against the projection 27 of container 5. The platform 40 is lowered by the length of the side 24 minus a tolerance, in such a way that the pawl 39 engages into the gap 28 of the container 5. The direction of movement of slide 37 is then reversed by the drive mechanism. After the slide 37 has overcome the retaining force of the detent spring 35, the container 5 is pulled out of rack 14, 15, onto the platform 40 and then lifted by vertical movement of conveying means 18 to the pivoting and shifting device 13 in order to be seized by the latter and to be passed through the opening 10. The deposition of the container 5 on the respective storage site 16 in rack 14, 15 takes place analogously in the reverse order.

For transporting the racks 14 and 15, respectively, the containers 5 are secured against withdrawal by means of a locking device 41. The locking device 41, arranged at the rack 14, is illustrated in FIG. 4 with locked-in-place containers 5 and in FIG. 5 with unlocked containers 5. The locking device has a movable slide 43 as shown in FIG. 10, with respectively one locking element 44 for each detent spring 35. The slide 43 is held by a spring 46 in its downward shifted condition wherein it locks the detent springs 35 and prevents them from moving transversely out of indentations 29. The slide 43 is secured in the locking position by means of a lock 47. The lock 47 has three locking bolts 51, 52, 53 retained on and moveable with the slide 43, with each being slidable transversely of the width of the slide 43 under the bias of a spring 49, respectively. In the locked condition of the lock 47, the locking bolts 51, 52, 53 are disposed in respectively one fixed shoulder 55, 56, 57 of a retaining bracket connected to the sidewall partition 32 of rack 14, 15. The slide 43, pretensioned by the spring 46, presses against the topmost locking bolt 53. The locking elements are disposed at the opposite site (the open part) of the arch of the pawl of the spring detent 35 behind each pawl 35. In this way spring detent 35 cannot be pushed out of the indentation 29, and pulling out of the containers 5 is impossible. The locking bolts 51, 52, 53 each have a milled-out area 61, 62, 63. These reamed-out areas 61, 62, 63 are arranged so that they taper in a stepwise fashion toward the top. In order to unlock the lock 47, an unlocking member 65 is inserted, as shown in FIG. 5, with two bevels at its tip into the stepwise tapering milled-out areas 61, 62, 63. The bevels are fashioned so that they displace the locking bolts 51, 52, 53 to the left in FIG. 5 out of the fixed shoulders 55, 56, 57 against the springs 49. Since the shoulders 55, 56, 57 no longer retain the locking bolts 51, 52, 53, the latter shift the slide 43 upwardly, with the unlocking member 65 being further advanced, until the locking elements 44 of the slide uncover and release the pawls of the detent spring 35. The purpose of the spring 49 is to press the locking bolts 51, 52, 53 against the shoulders 55, 56, 57, and the left sides of the milled-out areas 61, 62, 63 against the left bevel of the unlocking member 65 in FIG. 5. This means unlocking is only possible, if the unlocking member 65 has the right angles and positions of the two bevels.

Locking of the containers 5 takes place as early as at the moment when the action is begun of pulling the slide-in unit 19 with the carrier 17 out of the interior 6 of the safe. On the other hand, the containers 5 are unlocked at their storage sites 16 completely only once the slide-in unit 19 has been entirely inserted in the interior 6 of the safe. For this purpose, the carrier 17 has a horizontal bar 67 (FIG. 5) carried along with the carrier and exhibiting an oblique slot 69 occupied by a bolt 70 slot 69 from the bottom toward the top, points in the insertion direction 74 of the carrier 17. The unlocking member 65 is mounted at the carrier 17 to be vertically displaceable, and the bar 67 is mounted to the carrier to be horizontally movable. The bar 67 is pulled in the insertion direction 74 by means of a spring 71. In the rest position (not illustrated) wherein the slide-in unit 19 has been pulled out of the space 6, the unlocking member 65 is pulled downwards by the bar 67 out of the locking bolts 51, 52, 53; the bolt 70 is located at the lower end of the slot 69. Thereby, the spring 71 cannot pull the bar 67 any further.

During insertion of the rack 14, with the slide-in unit 19 having been pulled out of the interior 6 of the safe, on the location of the carrier 17 permitted by the pins 12 of the coding, and on the unlocking member 65, the latter, 65, is urged into the milled-out areas 61, 62, 63 of the locking bolts 51, 52, 53 only to such an extent that the locking bolts 51, 52, 53 are disengaged from the shoulders 55, 56, 57.

During the subsequent insertion of the carrier 17, the bar 67, shortly before the slide-in unit 19 has been entirely inserted, abuts against a fixed stop 73. By the continued insertion of the slide-in unit 19, the bar 67 is pushed with respect to the member 65 in the direction opposed to the insertion direction 74, and thereby the bolt 70 of the unlocking member 65 is moved upwardly along the incline of slot 69 to move unlocking member 65 upwardly to disengaged locking bolts 51, 52, 53, and thereafter the latter disengaged bolts together with the slide 43 are moved upwards relative to detent springs 35 until the locking elements 44 of the slide 43 release the detent springs 35. The locking action while the carrier 17 is pulled out takes place analogously in reverse sequence.

In order to unlock the containers 5 from the rack 14, after it is transported to the main safe room of the financial institution, an unlocking member corresponding to the unlocking member 65 is introduced, for example connected on a shelf, into the lock 47 to move the locking slide 43 upwards to the unlocked position.

Instead of providing a code at the racks 14 and 15, respectively, which merely fixes unequivocally their location within the carrier 17, the coding can be designed so that it can be scanned by, for example, mechanical or optical sensors. This would make it possible also to correlate the contents to the rack.

I claim:

1. Device for the storage, insertion, and removal of containers in and, respectively, from a secured space (6), comprising safe including a safe housing (1) surrounding the safe interior secured space (6), and a safe door (20);

said safe housing (1) having a first opening lockable by said safe door (20) and at least one second opening (10);

at least one rack (14, 15) having a plurality of storage sites (16) therein arranged in tiers in superimposed relationship;

a plurality of containers (5) inserted in said storage sites (16) of said rack (14, 15), said rack (14, 15) having a wall (32), each of said containers (5) positioned adjacent to said wall (32);

said first opening lockable by said safe door (20) being so vast that said at least one rack (14, 15) can be inserted in and, respectively, removed from said interior secured space of said safe housing (1) through said first opening;

said at least one second opening (10) being smaller than said first opening and dimensioned for the individual issuance and introduction of said containers (5) or container contents, respectively;

conveying means (18, 13) connected in said interior secured space (6) in said safe housing (1) for individually conveying said containers (5) from said storage sites (16) of said rack (14, 15) to said second opening (10) and back again;

means (17, 19) adapted for carrying said at least one rack (14, 15) to an operation place in said safe housing (1) in proximity to said conveying means (18, 13) and, respectively, away therefrom; and locking means on said at least one rack operative to lock said plurality of containers in said at least one rack upon removal of said at least one rack from said operation place in said safe housing, and to unlock said plurality of containers from said at least one rack upon positioning said at least one rack on said operation place.

2. Device according to claim 1, wherein said means (17, 19) adapted for carrying said at least one rack (14, 15) include a carrier (17) for the said at least one rack (14, 15), said carrier (17) being movably mounted in said safe housing (1) for carrying the at least one rack (14, 15) through said first opening lockable by said safe door (20) into said interior (6) of said safe housing (1) to said operation place and thereout again.

3. Device according to claim 1, wherein each of said containers having an indentation (29) thereon;

one resilient detent (35) on said rack (14, 15) for resiliently engaging said indentation (29) of each container (5), respectively;

said containers (5) in the rack (14, 15) are retained against slippage by means of said respective one detent (35), the retaining resilient force, by which said detent (35) is engaging into the indentation (29) being only of such a magnitude that it can be overcome by the conveying means (18), whereby the detent (35) retains the container (5) against vibrations in the rack (14) but is released during withdrawal of the containers (5) from the rack (14, 15) by the conveying means (18);

said locking means including a slide (43) moveable from an unlocking position into a locking position, said slide (43) having a locking element (44) thereon for each of said detents (35), said locking element (44), in the locking position of said slide overlying said detent 35 and preventing the detent (35) from being resiliently released; and said locking element (44) in the unlocking position of said slide (43) releasing said detent (35), so that in the latter position of the detent (35) can resiliently disengage from the indentation (29).

4. Device according to claim 3, including a lock (47) on said slide (43), and said slide (43) is secured in the locking position by means of said lock (47).

5. Device according to claim 1, in which said conveying means (18, 13) include a platform (40), connected to be moved respectively for withdrawing a container (5) from the rack (14, 15) into juxtaposition with one of the storage sites (16) in the rack, and towards said second opening (10) for the issuance and introduction of the container (5) or container content.

6. Device according to claim 1, in which said means (17, 19) adapted for carrying said at least one rack (14, 15) includes a carrier (17) for the said at least one rack (14, 15), said carrier (17) being movably mounted in said safe housing (1) for carrying the said at least one rack (14, 15) through said first opening lockable by said safe door (20) into said interior secured space (6) of said safe housing (1) to said operation place and thereout again, said carrier (17) having several receiving sites for respectively one rack (14, 15) associated therewith, and each receiving site and each rack (14, 15) having a cooperating coding means (11, 12) connected therebetween.

7. Device for the storage, insertion, and removal of containers in and, respectively, from a secured space (6), comprising a safe including a safe housing (1) surrounding the safe interior secured space (6), and a safe door (20);

said safe housing (1) having a first opening lockable by said safe door (20) and at least one second opening (10);

at least one rack (14, 15) having a plurality of storage sites (16) therein arranged in tiers in superimposed relationship;

a plurality of containers (5) inserted in said storage sites (16) of said rack (14, 15);

said first openingl lockable by said safe door (20) being so vast that said at least one rack (14, 15) can be inserted in and, respectively, removed from said interior secured space of said safe housing (1) through said first opening;

said at least one second opening (10) being smaller than said first opening and dimensioned for the individual issuance and introduction of said containers (5) or container contents;

conveying means (18, 13) connected in said interior secured space (6) in said safe housing (1) for individually conveying said container (5) from said storage sites (16) of said rack (14, 15) to said second opening (10) and back again;

a locking device (41) on each rack (14, 15) for locking all of the containers (5) in the rack (14, 15);

unlocking means (65, 67, 69, 70, 71, 73) having an unlocking member (65) for unlocking said locking device (41), said unlocking means (65, 67, 69, 70, 71, 73) being operatively connected in said safe in such a way, that the locking device (41) on said rack is unlocked by said unlocking member (65) upon carrying and positioning said rack (14, 15) in said safe housing (1) adjacent to said conveying means (18, 13) and, respectively, relocked, upon moving said rack (14, 15) away from said conveying means (18, 13) out of said safe housing (1), and a further unlocking member (65), whereby said containers (5) and their contents are locked in the rack (14, 15) when the rack is outside of said safe housing (1) and can be removed from the rack (14, 15) outside of the safe housing (1) solely after unlocking said locking device (41) by introducing said further unlocking member (65).

8. Device according to claim 7, wherein each of said containers (5) is open on one side thereof, said rack (14, 15) having a wall (32), and the open side of each of said containers (5) positioned adjacent to said wall (32) of said rack (14, 15).

9. Device according to claim 7, including means (17, 19) adapted for carrying said at least one rack (14, 15) to an operation place in said safe housing (1) in the proximity to said conveying means (18, 13) and, respectively, away therefrom.

10. Device according to claim 9, wherein said means (17, 19) adapted for carrying said at least one rack (14, 15) include a carrier (17) for the said at least one rack (14, 15), said carrier (17) being movably mounted in said safe housing (1) for carrying the at least one rack (14, 15) through said first opening lockable by said safe door (20) into said interior (6) of said safe housing (1) to said operation place and thereout again;

said unlocking means (65, 67, 69, 70, 71, 73) further including a displacement member (67) shiftably mounted on said carrier (17), a spring (71) connected between said carrier and displacing member (67), and a stop (73) fixedly disposed within said safe housing (1), said unlocking member (65) being supported on the carrier (17) and connected to be displaceable by means of said displacing member (67), said displacing member (67) being shiftable in the same direction as the carrier (17) from a rest position, in which said displacing member (67) holds said unlocking member (65) in a rest position, in which said locking device (41) is released by the unlocking member (65) and locks all of the containers (5) in the rack (14, 15), into an operative position, in which said displacing member (67) moves and holds said unlocking member (65) in an operative position, in which the locking device (41) is unlocked by the unlocking member (65); said displacing member (67) being shifted, when said carrier (17) is removed from the interior secured space (6) of the safe housing (1), into said rest position by means of said spring (71) and, when said carrier (17) carrying said at least one rack (14, 15), is moved to and positioned at said operation place, said displacing member (67) is shifted into said operative position by means of said stop (73) against the force of said spring (71).

11. Device according to claim 7, wherein each of said containers having an indentation (29) thereon;

one resilient detent (35) on said rack (14, 15) for resiliently engaging said indentation (29) of each container (5), respectively;

said containers (5) in the rack (14, 15), are retained against slippage by means of said respective one detent (35), the retaining resilient force, by which said detent (35) is engaging into the indentation (29) being only of such a magnitude that it can be overcome by the conveying means (18), whereby the detent (35) retains the container (5) against vibrations in the rack (14) but is released during withdrawal of the containers (5) from the rack (14, 15) by the conveying means (18); said locking device (41) including a slide (43) moveable from an unlocking position into a locking position, said slide (43) having a locking element (44) thereon for each of said detents (35), said locking element (44), in the locking position of said slide overlying said detent 35 and preventing the detent (35) from being resiliently released; and said locking element (44) in the unlocking position of said slide (43) releasing said detent (35), so that in the latter position the detent (35) can resiliently disengage from the indentation (29).

12. Device according to claim 7, in which said conveying means (18, 13) include a platform (40), connected to be moved respectively for withdrawing a container (5) from the rack (14, 15) into juxtaposition with one of the storage sites (16) in the rack, and towards said second opening (10) for the issuance and introduction of the container (5) or container content.

13. Device according to claim 9, in which said means (17, 19) adapted for carrying said at least one rack (14, 15) includes a carrier (17) for the said at least one rack (14, 15), said carrier (17) being movably mounted in said safe housing (1) for carrying the said at least one rack (14, 15) through said first opening lockable by safe door (20) into said interior secured space (6) of said safe housing (1) to said operation place and thereout again, said carrier (17) having several receiving sites for respectively one rack (14, 15) associated therewith, and each receiving site and each rack (14, 15) having a cooperating coding means (11, 12) connected therebetween.

14. Device according to claim 11, including a lock (47) on said slide (43) and said slide (43) is secured in the locking position by means of said lock (47).

15. Device according to claim 14, in which said slide (43) can be moved, by means of the unlocking member (65), further unlocking member 65, respectively, inserted in the lock (47), from the unlocking position into the unlocking position.

16. Device according to claim 15, including locking shoulders (55, 56, 57) connected on said rack (14, 15), said lock (47) comprises several spring-loaded locking bolts (51, 52, 52) that can be individually disengaged by said unlocking member (65), further unlocking member (65), respectively, against the spring-loaded force thereby from said locking shoulder (55, 56, 57), and said spring-loaded locking bolts in the disengaged condition, are jointly moved with said slide (43) by the unlocking member (65), whereby said slide (43) is moved from the locking position into the unlocking position.

* * * * *